United States Patent [19]

Afflerbaugh et al.

[11] Patent Number: 4,891,018

[45] Date of Patent: Jan. 2, 1990

[54] SOLDERLESS ELECTRICAL CONNECTOR

[75] Inventors: Martin G. Afflerbaugh; George J. Knox, both of Austin, Tex.

[73] Assignee: Minnesota Mining and Manufacturing Company, St. Paul, Minn.

[21] Appl. No.: 207,761

[22] Filed: Jun. 16, 1988

[51] Int. Cl.[4] ..... H01R 4/24

[52] U.S. Cl. ..... 439/402; 439/417; 439/418; 439/592

[58] Field of Search ..... 439/395–397, 439/402, 403, 409, 410, 412, 417–419, 592, 593, 936, 587, 588, 592

[56] References Cited

U.S. PATENT DOCUMENTS

| | | | |
|---|---|---|---|
| D. 191,399 | 2/1961 | Lasch | D26/1 |
| 2,800,635 | 7/1957 | Christenberg | 439/419 |
| 2,810,115 | 8/1955 | Abbott | 339/97 |
| 2,823,249 | 2/1958 | Curtiss | 439/588 |
| 3,012,219 | 3/1959 | Levin et al. | 339/98 |
| 3,233,206 | 5/1963 | Fiala | 339/98 |
| 3,377,611 | 3/1965 | Pawl | 339/97 |
| 3,496,522 | 4/1967 | Ellis, Jr. et al. | 339/99 |
| 3,511,921 | 11/1968 | Pasternak | 174/88 |
| 3,573,710 | 11/1968 | Wofford | 339/36 |
| 3,573,713 | 11/1968 | Enright | 339/98 |
| 3,576,518 | 11/1968 | Bazille, Jr. et al. | 339/98 |
| 3,605,072 | 2/1969 | Driscoll | 339/98 |
| 3,656,088 | 7/1970 | Seim | 339/98 |
| 3,718,888 | 1/1971 | Pasternak | 339/98 |
| 3,804,971 | 6/1972 | Bazille, Jr. | 174/88 |
| 3,890,029 | 6/1975 | Izraeli | 439/402 |
| 3,936,128 | 1/1975 | D'Annessa et al. | 339/98 |
| 4,444,447 | 4/1984 | Markwart | 439/409 |
| 4,496,206 | 1/1985 | Markwart et al. | 439/409 |
| 4,609,239 | 9/1986 | Abel et al. | 439/587 |
| 4,734,048 | 3/1988 | Giebel et al. | 439/409 |

FOREIGN PATENT DOCUMENTS

| | | | |
|---|---|---|---|
| 0077610 | 4/1983 | European Pat. Off. | 439/418 |
| 553570 | 5/1943 | United Kingdom | 439/588 |

OTHER PUBLICATIONS

Scotchlok Butt Connectors UAL, ULG, UR, UY, UP2, UP3—3M TelComm Products Division—Aug. 1, 1988.

*Primary Examiner*—David Pirlot

*Attorney, Agent, or Firm*—Donald M. Sell; Walter N. Kirn; John C. Barnes

[57] ABSTRACT

A solderless electrical connector formed of a polyolefin is formed with the same integrity as with harder polymeric materials when used with a connecting member of ductile material having a clearance slot between the wire receiving grooves and when formed to force the supporting cap into tight engagement with the inside surfaces of walls forming the base cap receiving cavity. The connecting member includes a passage for encapsulant to pass through the plate members.

13 Claims, 2 Drawing Sheets

SOLDERLESS ELECTRICAL CONNECTOR

BACKGROUND OF THE INVENTION

1. Field of the Invention

The present invention relates to an improvement in solderless electrical connectors to afford the same greater integrity and in one aspect to the improved mechanical locking features of the connectors and their ability to accommodate a variety of wire sizes.

2. Description of the Prior Art

The prior art is replete with patents utilizing the invention of the insulation displacing wire connection as disclosed in U.S. Letters Pat. No, 3,012,219. This patent discloses a connector comprising a base member, a wide U-shaped resilient conductive connector member and a cap fitting in a corresponding opening in the thickened upper portion of the base. U.S. Letters Patent No. Des. 191,399 discloses the stylized version of the connector and the general appearance of the connector as it has been sold by the assignee of the present invention for many years. The connector has undergone changes and improvements resulting in a variety of similar products but failing to provide the features of the present invention. Examples of these modifications include the teachings of U.S. Pat. Nos. 3,573,713; 3,656,088; 3,804,971 and 3,936,128.

Patent No, 3,012,219 and 3,656,088 disclose U-shaped resilient contact elements. In the earlier patent the slots 17 and 19 are adapted to join copper telephone wires of No. 19 to No. 26 gage and the contact element 15 is formed of 0.025 in. cartridge brass. The slots are adapted for redundant connections to the wires wherein the slots of the contact element shown in Pat. No. 3,656,088 are of different sizes to make connection with plastic coated aluminum wires. Similar connectors are marketed wherein the wider slots are used with connectors for copper wire with the wider slots affording strain relief.

The prior connectors, identified in the trade as assignee's UY connectors, were made of a stiff polycarbonate material and the connector member was formed of 260 cartridge brass of full hardness. The connector member comprised two wire connecting slots and the area between the slots in each connecting plate was not slotted. The UY connectors were not recommended for 19 gage wire and was not usable with some wires having thicker insulation.

Patent No. 3,936,128 discloses a solderless connector having a U-shaped contact 40 for connecting two wires disposed in a base 20. The contact 40 has two wire connecting slots with expansion slots 42 between the slots 41. The slots 41 have a key hole configuration to distribute the stresses created by connection to the wires.

In order to achieve a connector which will accommodate the wider range of wire sizes, i.e. No. 19 to No. 26, and which can be made of a less expensive material and which can withstand the stress associated with temperature change, lightning strikes, and other environmental causes, it was recognized that the connector had to be redesigned to have the same integrity.

The materials, generically at least, are not new and are not new to the connector area but the specific selection of these materials and the specific construction of the elements of the connectors are novel. The problems created by the mere change in materials requires the exercise of the inventive facility and in the connector of the present invention includes cooperative relationships between the elements which are not present in the prior art.

SUMMARY OF THE INVENTION

The present invention provides an improved wire connector for connecting a plurality of wires and comprises a base member having a plurality of side-by-side elongate wire-receiving channels having extended surfaces to support a corresponding plurality of wires. The base member is doubly deeply grooved across the extended surfaces and generally perpendicular to the channels and has an opening above the grooves. Wall members extend from the inner peripheral edge of the opening toward the channels to define a truncated conical cavity withthe walls of the cavity diverging from the opening at an angle of about $6^0$ to the bottom of the cavity. A U-shaped resilient conductive connecting member affords connection between wires in the channels and the legs of the U-shaped member are wide thin closely spaced and deeply grooved plates adapted to fit within the parallel grooves and with a slot in each plate in line with each of the channels. A clearance slot is disposed in each plate between each of the wire receiving slots in line with the channels. A cap of insulative material supports the connecting member and the cap comprises an end wall, depending side walls having two legs depending beyond the free edges of the walls at peripherally spaced locations to be disposed adjacent opposite ends of the plates of the U-shaped connecting member, and a peripheral rib projecting from the outer surface of the side walls. The outer peripheral dimension of the free edges of the depending side walls is slightly greater than the inside dimension of the opening in the base member and the legs are disposed inside the cavity of the base.

When force is applied against the end wall of the cap forcing it in a direction toward the base, the opening in the base member will be forced to expand allowing entry of the cap and connecting member into the cavity in the base whereby the connecting member affords fully effective spring reserve contact with the wires disposed in said channels.

The wire connecting member is formed of 0.0159 inch conductive metal, such as a ductile copper alloy, e.g. 260 cartridge brass. The hardness is selected to be $\frac{3}{4}$ hard for greater ductility.

The base is formed of flexible polyolefin affording it to stretch slightly for receiving the cap in a locking position which will restrict its displacement under the stress resulting from temperature change, lightning strikes and other environmental causes. The cap can be formed of similar material to allow flexure during insertion and flexure of the legs upon the resilient bending of the connecting member.

The base may comprise a web extending parallel to the channels and interrupting the clearance slot between the wire receiving channels. The web has a width to be normally received in the clearance slot but is deformed as a wire is received in the wire receiving slots causing the width of the clearance slot to be narrowed. The narrowing of the clearance slot and the resultant pinching of the web further affords a mechanical locking of the connecting member to the base.

A sealant of grease like consistency is placed in the base cavity when the connectors are assembled and to assure uniform distribution of the sealant and a coating of the junction between the wires and the connection member the clearance slot may also have opposed cutouts forming passage means in the sides of the slot to improve the flow of the sealant during the closing of the cap onto the base when connecting several wires. The wire receiving slots of the connecting member of the present invention have the same width. This provides for redundant contact with the wires to assure good electrical connection.

BRIEF DESCRIPTION OF THE DRAWING

The present invention will be further described with reference to the accompanying drawing, wherein.

DESCRIPTION OF THE PREFERRED EMBODIMENT

Figure 1:
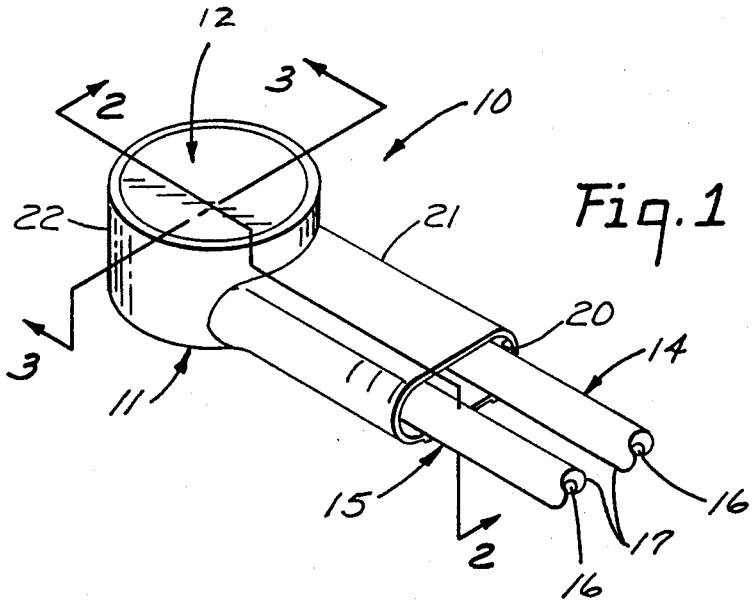
FIG. 1 is a perspective view of a connector according to the present invention shown in closed wire contacting position.

The present invention will be described with reference to the drawing wherein like reference numerals refer to like parts throughout the several views.

Figure 5:
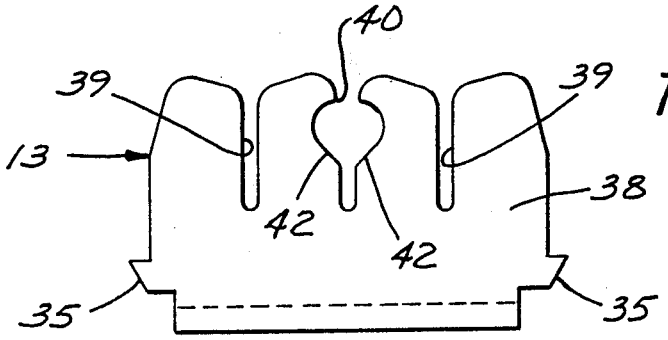
FIG. 5 is a front elevational view of the connecting element of the present invention.

The connector 10 of FIG. 1 comprises an insulating base 11 and an insulating cap 12. A generally U-shaped, conductive connecting member 13 (see FIG. 5) is supported by the cap 12 and affords good electrical contact with a pair of wires 14 and 15, each including a conductor 16 having an insulative coating 17.

Figure 2:
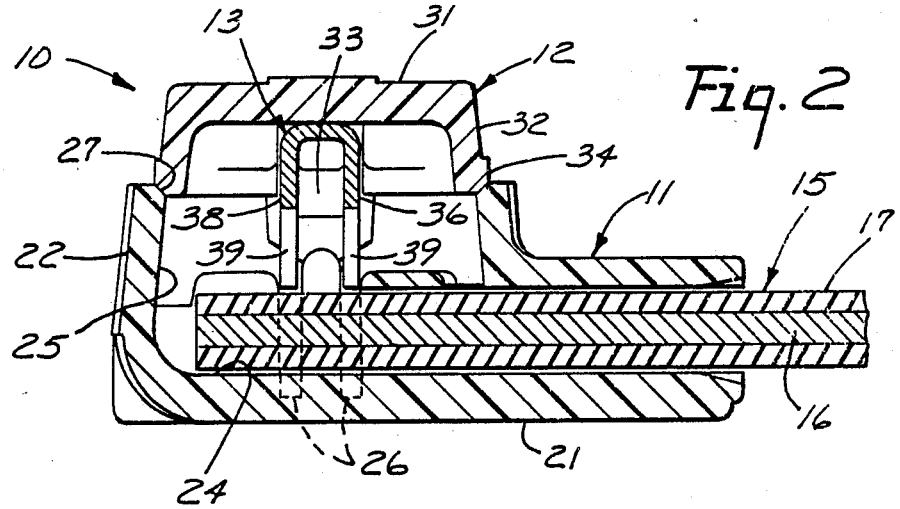
FIG. 2 is a longitudinal vertical sectional view taken along line 2—2 of FIG. 1 but showing the cap and connecting member in the open or non-connecting position.
Figure 3:
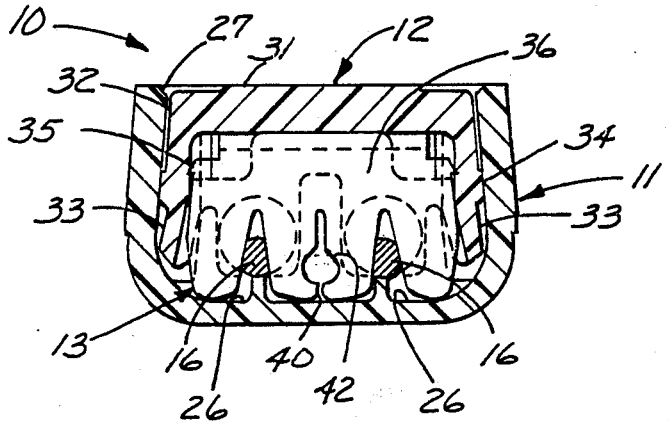
FIG. 3 is a transverse sectional view taken along line 3—3 of FIG. 1.

The base 11 comprises multiple longitudinal side-by-side tubular wire-receiving passages 20 for insertion of wire-ends to be connected. The passages 20 begin at an end of a throat portion 21 of the base 11 and extend into a body portion 22 where they provide wire supporting channels 24, see FIG. 2. The interior of the body portion 22 is formed with a cavity 25 communicating with the channels 24 and the base of this cavity 25 is deeply grooved across the channels 24 to provide slotted areas 26 to receive the legs of the connecting member 13. The cavity 25 has a generally truncated conical shape and extends from an opening in the upper extended body portion 22 to the wire supporting channels 24 and is defined by interior wall surfaces which are disposed at an angle of about 6° to the axis of the conical cavity. The wall surfaces defining the cavity 25 are formed with a support surface 27 to support the cap 12 with the depending legs thereof extending into the cavity 25 and engaged with the walls thereof to retain the cap 12 on the base 11 in an open position. The surface 27 and the bottom surface of the cap 12 cam the opening of the cavity to an open position to accept the larger cap.

The base 11 is preferably molded of a flexible polymeric material which is preferably translucent, solvent resistant and hydrophobic and is resilient, i.e. it has good tensile strength and sufficient modulus of elasticity to afford 10 to 20% elongation. A preferred material with these properties is a polyolefin, for example polypropylene which is less expensive then polycarbonate.

The cap 12 is the support for the connecting member 13 and can also be formed of polypropylene. The cap 12 comprises an end or top wall 31 and generally conical, peripheral side walls 32. Extending from the free edges of the side walls 32, at opposed sides thereof, are a pair of legs 33. The legs 33 are generally channel-like and are disposed at opposite ends of the legs 36 and 38 of the connecting member 13. When the cap is in the open position the legs 33 cooperate with the inner surface of the cavity walls of the base to retain the cap in place and the connecting member in place for joining the wires. The cap has an outer raised circumferential or peripheral ring or rib 34 above a beveled surface on the free edges of the side walls 32.

The connecting member 13 is formed of electrically conductive ductile metal, about 0.0159 inch (0.4 mm) thick, such as a copper alloy, e.g. 260 cartridge brass. The hardness is preferably ¾ hard or Hϕ3. The connecting member 13 is supported within the cap 12 and is retained therein by two oppositely projecting barbs 35, one disposed at each end of thin plates 36 and 38 forming the legs of the U-shaped connecting member 13. The plates 36 and 38 are parallel and spaced about 0.050 inch (1.27 mm) apart. The barbs 35 engage the base surface of the channel-like legs 33. Each of the plates 36 and 38 is provided with a deep wire receiving slot 39 positioned in aligned relationship with a wire supporting channel. The slots 39 are spaced 0.126 inch (3.2 mm) apart in each plate. Disposed between the wire receiving slots 39 is a clearance slot 40 which affords greater flexibility for the connecting member. The wire-receiving U-slots 39 are originally 0.0115 inch (0.29 mm)in width between the parallel portions of the opposing jaws. It is forced open to about 0.014 inch (0.36 mm) when measured through an approximate center of the deformed conductor when a 26 gauge wire is inserted into the connector. This is past the yield point of the material and the resilience of the material affords a return toward the original position to a 0.012 to a 0.0125 inch width (0.30 mm to a 0.317 mm). A 19 gage wire forces the slot open to about 0.025 inch (0.63 mm). This is also past the yield point. The slot width relaxes to about 0.023 inch (0.58 mm) when the wire is removed. Therefore, even with the material being stressed beyond the yield point there is a continuous resilient force on the wire to maintain good electrical contact due to the elastic deformation of the material forming the connecting member 13.

The geometry of the connecting member 13 allows the plastic deformation without fracturing the connecting member. This is accomplished by the presence of a clearance slot 40 disposed between the wire receiving slots 39. Since the parallel walls of the slots 39 are forced apart as a conductor enters the flared entrance thereto the wire pushes the narrow band of material on one side of the U-slot 39 toward the center of the plate which forces the clearance slot 40 to close at the entrance and forces the material on the other side of the U-shaped slot toward the end of the plate. There is approximately equal movement on each side of the wire. Further, the tendency of the connecting element to fracture when undergoing any plastic deformation is reduced by placing a radius at the bottom of the slot which is somewhat larger than 1.5 times the width of the slot to afford reduced stress concentration without loss of effectiveness in making good electrical contact.

The deflection of the material of the plates 36 and 38 from the slots 39 toward the ends serves to urge the legs 33 of the cap 12 firmly against the inner surface of the walls forming the cavity 25. Further, the raised rib 34 is forced tightly against the cavity walls and the sharp edge on the side of the rib near the end wall 31 will resist forces tending to dislodge the cap 12. Therefore, as the cap 12 is inserted into the base 11, the making of the junction with the conductor 16 of the wires also improves the mechanical fastening of the cap to the base. This occurs by the plates 36 and 38 of the connecting member 13 expanding at their free edge forcing the legs 33 of the cap and the side walls 32 outwardly against the walls of the base portion 22. As the walls of the base return or relax to the normal unstretched position after the cap is moved into the closed position, the walls of the cavity have again a negative angle to hold the cap.

The connecting member 13 is also provided with a opening 42 in each plate 36 and 38. This opening 42 is preferably positioned centrally of the member 13 and as illustrated is formed in a sidewall of the clearance slot 40. As illustrated two such openings 42 are defined by arcuate walls formed in opposed relationship forming a heart shaped passage means for allowing an encapsulant placed in the connector to pass from one side of the connecting member 13 to the other as force is applied during the closing of the cap 12. Effective encapsulation of the connection to restrict the subsequent entry of water is obtained by soft plastic materials, usually of grease like consistency such as polyisobutylene, silicone greases, or a sealant sold by the Assignee of this application which comprises polybutene synthetic rubber, mineral oil, amorphous silica and an antioxidant. The encapsulant completely fills all interstices within the connector and preferably fills the tubular wire receiving passages.

Figure 4:
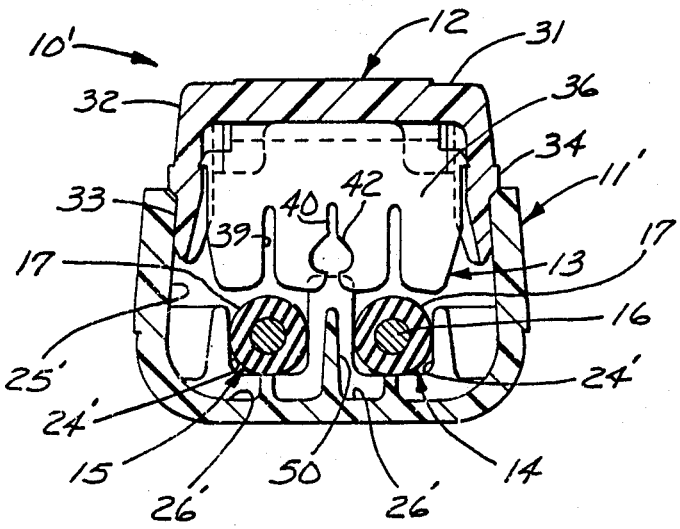
FIG. 4 is a transverse sectional view of the connector of the present invention taken along the same general area as FIG. 3 but showing the connector in the open position and showing a second embodiment of the base.

Referring now to FIG. 4, there is illustrated a second embodiment of a connector constructed according to the present invention. This connector, generally designated 10', comprises a base 11', a cap 12, corresponding in all respects to the cap 12 described above since it is a like part, and a connecting member 13. The base 11' is distinguished from the base 11 in that a web 50 is disposed in each slotted area 26' of a cavity 25' and is positioned to extend parallel to two wire receiving channels 24' and is positioned therebetween. The web 50 has a width and height to be received within the clearance slot 40 of the connecting member 13. In operation, the cap 12 is closed on the base 11' and the web enters the clearance slot 40 as the wire coatings 17 are being displaced by the plates 36 and 38 of the connecting member. As the cap is closed further the walls defining the clearance slot 40 begin to squeeze the web 50 and actually displace the material of the web as the cap is fully closed. The intersection between the arcuate walls 42 and the side walls forming the clearance slot 40 and the flared opening thereto form edges defining a pincher-like member on each plate 36 and 38. The material of the plates that is forced toward the center of the plates 36 and 38 thus clamp onto the web 50 at the openings of the two clearance slots. This squeezing of the web 50 serves to further enhance the mechanical fastening of the cap 12 in place on the base and restrict it's displacement in event of stress on the junction between the conductors 16 and the connecting member 13 due to temperature changes, lightning strikes or other environmental causes. The pasageway defined by the cut-out 42 of the slots 40 still permit the flow of the encapsulant, not shown.

The present invention thus provides an improved connector for making good electrical connection and which uses less expensive materials in such a way as to provide redundant connection to a greater range of wire sizes.

Having thus described the present invention with reference to the preferred embodiment, it will be appreciated the further modifications may be made without departing from the spirit of the invention as defined in the appended claims.

We claim:

1. A wire connector for connecting a pair of wires comprising;

a translucent polyolefin base member having a plurality of side-by-side elongate wire-receiving channels having extended surfaces to support a corresponding plurality of wires, said base member being doubly deeply grooved across said surfaces and generally perpendicular to said channels, an opening above said grooves and wall members extending from the inner peripheral edge of said opening toward said channels to define a truncated conical cavity with the walls of the cavity diverging from the opening at an angle of at least about 6° from said peripheral edge to the base of said cavity, a U-shaped resilient connecting member formed from about 0.4mm thick conductive metal, the legs of the U being wide thin closely spaced and deeply grooved plates adapted to fit within the parallel grooves and with a groove in each plate in line with each of said channels, said grooves being of the same size, and a clearance slot in each plate disposed between each of the grooves in line with the channels, and a cap supporting said connecting member and shaped to fit in said cavity, said cap comprising a circular end wall and depending side walls having two legs extending beyond the free edges of the side walls at generally diametrically spaced locations, said connecting member being positioned between said legs and against the interior surface of said end wall, the outer peripheral dimension of the free edges of said depending side walls being slightly greater than the inside dimension of the opening in said base member, and said legs of said cap being disposed inside said cavity, whereby when force is applied against said end wall of the cap forcing it in a direction toward said base member said opening in the base member will be forced to expand allowing entry of said cap and connecting member into said cavity whereby said plates of said connecting member are forced against said legs as a wire enters said grooves in said plates forcing said legs into engagement with said wall members to restrict said cap from being displaced from said cavity and further afford fully effective spring reserve contact with the wires disposed in said channels.

2. A wire connector according to claim 1 wherein said cap has an external peripheral rib on said side walls the peripheral dimensions of which exceed the inner peripheral dimensions of said peripheral edge of said opening of said base to restrict movement of said cap out of said cavity following entry of said cap into said cavity.

3. A wire connector according to claim 1 wherein said polyolefin is polypropylene.

4. A wire connector according to claim 1 wherein said connecting member is formed of about 0.4 mm thick conductive metal.

5. A wire connector according to claim 4 wherein said metal is a ductile copper alloy of three quarters hardness.

6. A wire connector according to claim 4 wherein said plates are spaced 1.27 mm apart.

7. A wire connector according to claim 4 wherein said base is formed of flexible polypropylene.

8. A wire connector for connecting a pair of wires comprising;

a base member having a plurality of side-by-side elongate wire-receiving channels having extended surfaces to support a corresponding plurality of wires, said base member being doubly deeply grooved across said surfaces and generally perpendicular to said channels, having an opening above said grooves and wall members extending from the inner peripheral edge of said opening toward said channels to define a truncated conical cavity with the walls of the cavity diverging from the opening at an angle of at least about $6^0$ from said peripheral edge to the base of said cavity, a U-shaped resilient conductive connecting member, the legs of the U being wide thin closely spaced and deeply grooved plates adapted to fit within the parallel grooves and with a groove in each plate in line with each of said channels and a clearance slot in each plate disposed between each of the grooves in line with the channels, said base further comprising a web extending parallel to said channels and aligned with said clearance slot and having a width to be normally received within said clearance slot but being deformed as a wire is received in said grooves, and a cap supporting said connecting member and shaped to fit in said cavity, said cap comprising an end wall and depending side walls having two legs extending beyond the free edges of the side walls at peripherally spaced locations, said connecting member being positioned between said legs and against the interior surface of said end wall, the outer peripheral dimension of the free edges of said depending side walls being slightly greater than the inside dimension of the opening in said base member and said legs being disposed inside said cavity, whereby when force is applied against said end wall of the cap forcing it in a direction toward said base member said opening in the base member will be forced to expand allowing entry of said cap and connecting member into said cavity whereby said connector affords fully effective spring reserve contact with the wires disposed in said channels.

9. A wire connector according to claim 8 wherein said wire receiving grooves have the same width.

10. A wire connector according to claim 8 wherein said connecting member has opening means in the legs thereof for allowing plastic encapsulant within said base to flow through said legs.

11. A wire connector according to claim 8 wherein said connecting member is formed of about 0.4 mm thick metal with said plates spaced 1.27 mm apart and said connecting member having passage means through said plates for allowing an encapsulant to pass through said plates to restrict displacement of said connecting member when moving said cap to closed position.

12. A wire connector according to claim 8 wherein said cap has an external peripheral rib on said side walls the peripheral dimensions of which exceed the inner peripheral dimensions of said peripheral edge of said opening of said base to restrict movement of said cap out of said cavity following entry of said cap into said cavity 13. A wire connector for connecting a pair of wires comprising;

a base member having a plurality of side-by-side elongate wire-receiving channels having extended surfaces to support a corresponding plurality of wires, said base member being doubly deeply grooved across said surfaces and generally perpendicular to said channels, an opening above said grooves having an inner peripheral edge and wall members extending from the inner peripheral edge of said opening toward said channels to define a truncated conical cavity with the walls of the cavity diverging from the opening at an angle of at least about $6^0$ from said peripheral edge to the base of said cavity, and a U-shaped resilient conductive connecting member, the legs of the U being wide thin closely spaced and deeply grooved plates adapted to fit within the parallel grooves, a groove in each plate in line with each of said channels and arcuate cutout means in the walls defining a clearance slot in each plate disposed between each of the grooves in line with the channels for affording an encapsulating grease to pass through said plates, said base further comprising a web extending parallel to said channels and aligned with said clearance slot and having a width to be normally received therein but being deformed as a wire is received in said grooves, and a cap supporting said connecting member and shaped to fit in said cavity, said cap comprising an end wall and depending side walls having two legs extending beyond the free edges of the side walls at peripherally spaced locations, said connecting member being positioned between said legs and against the interior surface of said end wall, the outer peripheral dimension of the free edges of said depending side walls being slightly greater than the inside dimension of the opening in said base member and said legs being disposed inside said cavity, whereby when force is applied against said end wall of the cap forcing it in a direction toward said base member said opening in the base member will be forced to expand allowing entry of said cap and connecting member into said cavity whereby said connector affords fully effective spring reserve contact with the wires disposed in said channels and said cap fits snugly in said cavity.

* * * * *

UNITED STATES PATENT AND TRADEMARK OFFICE

CERTIFICATE OF CORRECTION

PATENT NO. : 4,891,018

DATED : January 2, 1990

INVENTOR(S) : Martin G. Afflerbaugh, George J. Knox, and Edward R. Vanderbilt

It is certified that error appears in the above-identified patent and that said Letters Patent is hereby corrected as shown below:

Title page under "Inventors" add "Edward R. Vanderbilt."

Col. 2, line 16, "withthe" should read --with the--

Col. 5, line 68, "pasageway" should read --passageway--

Signed and Sealed this

Eighth Day of January, 1991

*Attest:*

HARRY F. MANBECK, JR.

*Attesting Officer*

*Commissioner of Patents and Trademarks*